US006758204B1

(12) United States Patent
Goff et al.

(10) Patent No.: US 6,758,204 B1
(45) Date of Patent: Jul. 6, 2004

(54) SHORT COMPOUND BOW

(76) Inventors: Jerry Alan Goff, 9278 Frank Lodner Rd., Saucier, MS (US) 39574; Sherwood L. Goff, Sr., 21595 Yankee Town Rd., Saucier, MS (US) 39574

( * ) Notice: Subject to any disclaimer, the term of this patent is extended or adjusted under 35 U.S.C. 154(b) by 0 days.

(21) Appl. No.: 10/436,904

(22) Filed: May 12, 2003

(51) Int. Cl.[7] ..... F41B 5/10
(52) U.S. Cl. ..... 124/25.6
(58) Field of Search ..... 124/23.1, 25, 25.6

(56) References Cited

U.S. PATENT DOCUMENTS

| | | | | |
|---|---|---|---|---|
| 3,397,685 | A | 8/1968 | Walker | 124/24 |
| 3,486,495 | A | 12/1969 | Allen | 124/24 |
| 4,241,715 | A | 12/1980 | Jennings | 124/24 |
| 4,368,718 | A | 1/1983 | Simonds et al. | 124/23 |
| 4,401,097 | A | 8/1983 | Simonds et al. | 124/23 |
| 4,457,287 | A | 7/1984 | Babington | 124/23 |
| D282,481 | S | 2/1986 | Smith | D22/5 |
| 4,662,344 | A * | 5/1987 | Mitchell | |
| 4,739,744 | A | 4/1988 | Nurney | 124/23 |
| 4,881,514 | A * | 11/1989 | Denslow et al. | |
| 4,957,093 | A | 9/1990 | Hamlett | 124/24.1 |
| 4,976,250 | A * | 12/1990 | Jeffrey | |
| 5,054,463 | A | 10/1991 | Colley et al. | 124/25.6 |
| 5,349,937 | A | 9/1994 | Burling | 124/25.6 |
| D361,365 | S | 8/1995 | LaHaise, Sr. | D22/107 |
| 5,623,915 | A | 4/1997 | Kudlacek | 124/25.6 |
| 5,651,354 | A | 7/1997 | La Haise, Sr. | 124/23.1 |
| 5,671,723 | A | 9/1997 | Goff et al. | 124/35.2 |
| 5,682,871 | A * | 11/1997 | Walk et al. | |
| 5,967,132 | A | 10/1999 | Loomis | 124/23.1 |
| 6,142,133 | A | 11/2000 | Anderson | 124/25.6 |

OTHER PUBLICATIONS

Article entitled "The Forward–Handle and Overdraw Bows" by Freddie Troncoso, Bow & Arrow, Jun. 1982, pp. 24–25.

Article entitled "Fast Cat—The Martin Jaguar Forward Handle Cam Bow Proves To Be A Fast Hunter" by C.R. Learn, Bow & Arrow, Oct. 1983, pp. 36–37, 44, 50.

Article entitled "Micro–Bows—Bows Are Getting Shorter, But Are They Better" by Bill Winke, Outdoor Life, Sep. 2001, pp. 85–86.

Advertisement for a torque–free bow, Bow & Arrow, Oct. 1986, p. 94.

* cited by examiner

*Primary Examiner*—John A. Ricci
(74) *Attorney, Agent, or Firm*—Drinker Biddle & Reath LLP

(57) ABSTRACT

A compound bow with a short axle to axle length is disclosed. The bow has a relatively long brace height and a relatively short power stroke. The bow includes a riser with a forwardly disposed grip, a rearwardly disposed vertically extending portion, which makes up most of the length of the riser. The riser further includes a limb-engaging portion extending forwardly from each end of the vertically extending portion so that the limb-engaging portions are substantially in vertical alignment with the grip. A resiliently flexible limb extends at a steep rearward angle from each of the limb-engaging portions. In addition, the riser can be made with slideable end portions so that the brace height and draw length of the bow can be adjusted to an individual user's preference.

37 Claims, 5 Drawing Sheets

30a
33a
28a
LA
26
38
34a
24a
42
L
14
16
58
VAB
36
10
22
BH
18
20
32
44
12
24b
34b
40
26
LB
28b
33b
30b

SHORT COMPOUND BOW

FIELD OF THE INVENTION

The invention relates to the field of archery. More specifically, the invention relates to a short compound bow.

BACKGROUND OF THE INVENTION

Archery bows have been known for centuries. Compound bows are a relatively recent development. It is widely believed that Holless W. Allen introduced the first one in 1967. The early compound bows included an eccentric wheel or cam, which provided a lesser pull weight (or let-off) at full draw than the maximum weight applied at an intermediate draw position. Thus, the compound bow stores a substantial amount of energy without requiring the archer to hold the maximum draw weight while aiming or waiting for a clear shot opportunity.

The technology of compound bows has evolved since Mr. Allen's initial designs, including attempts to reduce the overall bow length. A short length makes carrying and handling the bow less cumbersome, a particular advantage in a blind or tree stand. However, attempts to shorten compound bows have met with problems because reducing the bow length tends to amplify certain forces acting on and within the bow. One such force is the torque caused by small angle differences between the grip/hand pressure and the draw line. Torque can cause unintended bow movement when the string is released, with consequent loss of accuracy.

Another consideration unique to compound bows is the need to displace the power cables away from the plane of the bowstring. Each power cable connects one end of the bowstring to the opposite limb through a pulley. Without some means of moving the power cables to the side, they would interfere with the travel of the bowstring and the arrow. Thus, cable guards have been developed to move the power cables to one side. Although these cable guards prevent interference with the arrow, the angle of displacement between the power cables and the plane of the bowstring at the pulleys creates another torque on the bow. In bows with a long bow length, measured axle to axle, the displacement angle is relatively small and, therefore creates little torque. However, as the length of the bow is decreased and the displacement distance of the power cables remains constant, the angle becomes larger and more torque is created.

Because torque is a hindrance to accuracy, efforts to reduce the length of compound bows have compromised accuracy. Although axle to axle length for hunting compound bows has dropped from the 40-inch range to closer to 30 inches, attempts to reduce the length of the bow to less than 30 inches have resulted in a trade-off in accuracy.

SUMMARY OF THE INVENTION

This invention relates to a well-balanced and accurate compound bow having a very short axle to axle length, a relatively long brace height and a relatively short power stroke. The bow includes a unique riser having a forwardly disposed grip, a rearwardly disposed portion extending generally vertically which makes up most of the riser length, and a limb-engaging portion extending forwardly from each end of the vertically extending portion a sufficient distance so that the forward edges of the limb-engaging portions are substantially in vertical alignment with the forward edge of the grip. A flexible resilient limb is connected to the riser at each limb-engaging portion. The limbs extend rearward at a steep angle to the vertical axis of the bow. The bow further includes a pulley mounted on an axle at the unsupported end of each limb, and a bowstring and power cable system associated with the pulleys.

The above-described configuration provides the compound bow with a center of mass above and rearward of the grip, and, therefore, a vertical axis of balance rearward of the grip. Because the limb engaging portions of the riser are substantially in vertical alignment with the grip, the vertical axis of balance is also rearward of the limb-engaging portions. The location of the vertical axis of balance relative to the grip and limb-engaging portions imparts excellent balance to the bow when it is drawn and released. The enhanced balance allows the limbs to be configured at a relatively steep angle from a vertical line drawn from the back of the grip. The steeply angled limbs, in combination with the size and configuration of the riser, provide a short overall bow length, as measured axle to axle, a relatively long brace height and a relatively short power stroke. The enhanced balance of the bow permits accurate shooting of fast, short arrows, despite the short bow length. Thus, the present invention provides a short compound bow with excellent accuracy and arrow speed.

Definitions

The term "belly" used in connection with a bow riser means the surface of the riser, or portion of the riser, that is closest to the archer user when holding the bow in the pre-draw position.

The term "back" used in connection with a bow riser means the surface of the riser, or portion of the riser, that is farthest from the user when holding the bow in the pre-draw position.

The term "brace height" means the distance from the belly of the grip at its deepest point to the bowstring when not drawn.

The term "draw length" is the distance from the belly of the grip at its deepest point to the bowstring (at the nock) when drawn.

The term "power stroke" represents the distance the nock is displaced when the bowstring is drawn.

The term "rearwardly" refers to a direction that starts from the back of the riser and progresses toward the bowstring. "Rearward" of an element or position is the state of being in a vertical plane that is located farther away from the back of the riser than is the element or position.

The term "forwardly" refers to a direction that starts from the bowstring and progresses toward the back of the riser. "Forward" of an element or position is the state of being in a vertical plane that is located farther away from the bowstring than is the element or portion.

The term "pulley" is meant to include cams, wheels and eccentric wheels, or positions thereof.

The term "vertical axis of balance" is a vertical line through the center of mass of a bow when the bow is held upright.

The term "plane of the bowstring" is used to indicate the plane through which the bowstring travels as it is drawn and released. An arrow also travels through the plane of the bowstring.

BRIEF DESCRIPTION OF THE DRAWINGS

For the purpose of illustrating the invention, there is shown in the drawings a form which is presently preferred.

it being understood, that this invention is not limited to the precise arrangements and instrumentalities shown.

DETAILED DESCRIPTION OF THE DRAWINGS

Figure 1:
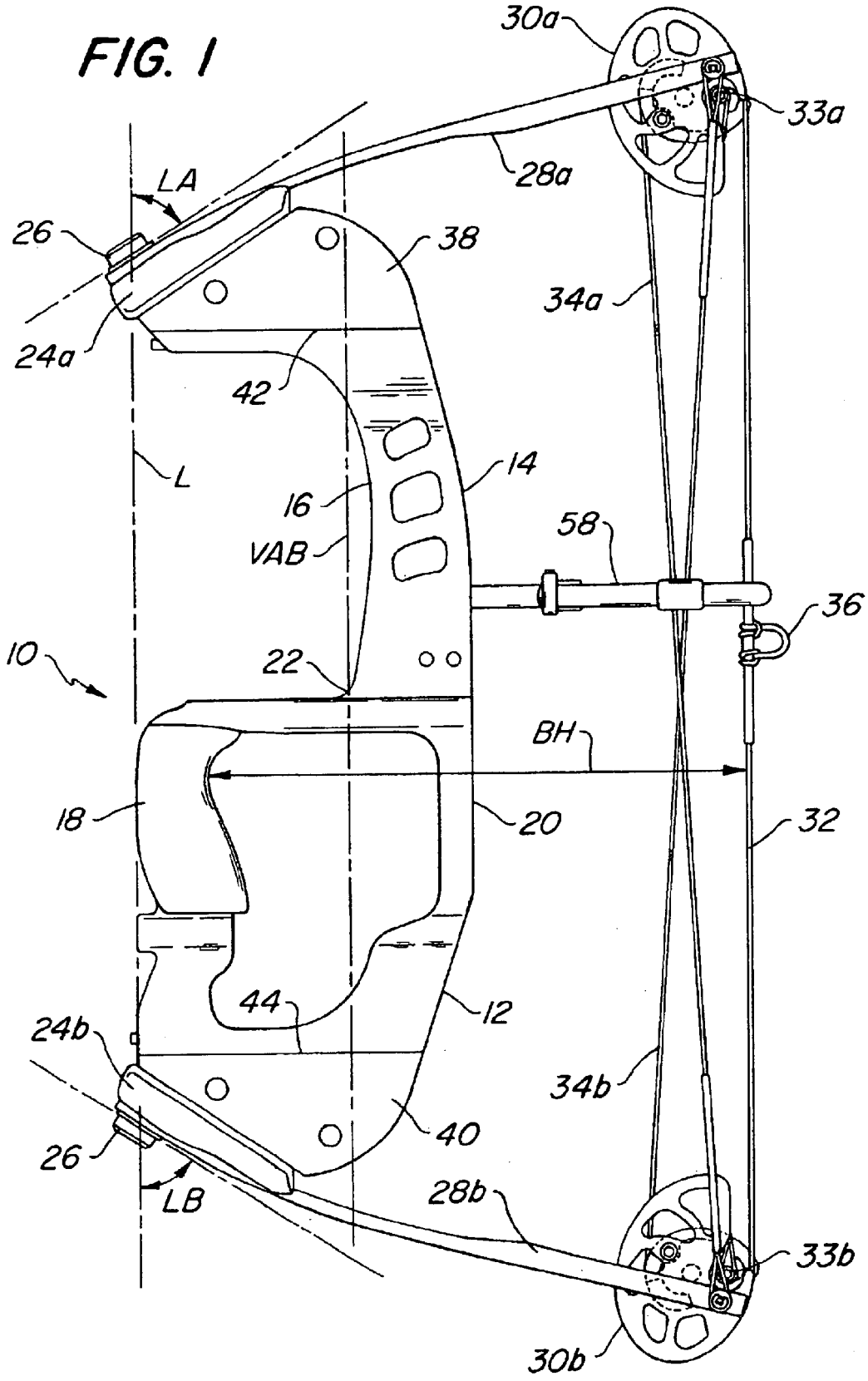
FIG. 1 is a side view of a compound bow according to the present invention.

The Figures show a preferred embodiment of a compound bow 10 according to the present invention. As shown in FIG. 1, the bow 10 includes a riser 12, which has a belly 14 and a back 16. The riser includes a grip 18 and a vertically extending portion 20. The grip and vertically extending portion can be formed as a unitary construction by machining both element from an extrusion blank or sheet of, for example, aluminum or lightweight metal alloy. The riser could also be molded from carbon, wood, fiberglass, plastic, composites or other rigid materials. After the grip and vertically extending portions are formed, various other components, such as a rubber grip cover, may be added.

The grip 18 is disposed well forward of the vertically extending portion 20, and the center of mass 22 of the bow 10 is well behind the grip 18. In the particular embodiment shown in the drawings, the center of mass 22 is located near the back of the riser above and well rearward of the grip 18. The position of the center of mass 22 (but not necessarily the fact that it is near the back of the riser) provides the bow 10 with a vertical axis of balance "VAB" located well behind the grip. It should be noted that the center of mass 22 and the vertical axis of balance will usually move even more to the rear of the grip when adding accessories, such as a rest, sights, stabilizer bar, or the like, since most accessories will mount on the vertically extending portion 20 and extend backwards from it, thereby causing the axis to move rearwardly from the position shown in FIG. 1. Thus, the vertical axis of balance (VAB) can be in the position shown or in a more rearward position.

The shape of the riser 12, and the unitary construction of the grip 18 and vertically extending portion 20 make the riser compact, lightweight and durable. In this embodiment, the large void that is cut out behind the grip not only reduces weight, it can be used as a foot stirrup to draw and latch the string at full draw with a device such as depicted in U.S. Pat. No. 6,161,532, which is hereby incorporated by reference, and sold under the mark DRAW LOC®.

At each end of the vertically extending portion 20 is a limb-engaging portion extending forwardly of the vertically extending portion 20. The limb-engaging portions can include traditional limb pockets 24*a* and 24*b*. The front of the limb pockets 24*a* and 24*b* are substantially in vertical alignment with the front of the grip 18. In fact, in the preferred embodiment, a vertical line "L" drawn from the front of the grip 18 extends through limb bolts 26.

Resiliently flexible limbs 28*a* and 28*b* are supported by the limb pockets 24*a* and 24*b*. The limbs 28*a* and 28*b* can be commercially available fiberglass limbs. The limb 28*a* extends at an initial rearward angle "LA" of about 57 degrees from the line L. Stringing and pre-tensioning of the bow 10 flexes the limb 28*a* to provide a steep overall limb angle of about 72 degrees. Similarly, the limb 28*b* extends from the limb pocket 24*b* at an initial rearward angle "LB", which may also be about 57 degrees, and a steep overall angle of about 72 degrees after pre-tensioning. The steeply angled limbs 28*a*, 28*b* provide for a relatively small amount of limb displacement when the bow 10 is drawn. Although dependent on the draw length of the archer, each limb can displace about 1¾ inches at full draw. The small displacement distance minimizes vibration during shooting and extends the useful life of the flexible limbs 28*a*, 28*b*.

A pulley 30*a* and 30*b* is mounted on an axle at the free end of each of the limbs 28*a* and 28*b*. The distance between the axles of the bow 10 can be shorter than 28 inches and is preferably between 23 and 25 inches, most preferably about 24 inches. The pulleys 30*a*, 30*b* are preferably cams or eccentric wheels, which can allow a substantial let-off at full draw. Cams and eccentric wheels are well known in the art, having been first shown in U.S. Pat. No. 3,486,495 to Allen. As shown in the drawings, it is preferred that each of the pulleys 30*a*, 30*b* are of a double cam configuration having an outer cam and an inner cam. The inner and outer cams are preferably arranged to provide about a 75% let-off of initial draw weight at full draw. One of the pulleys can alternatively be a concentric wheel.

A bowstring 32 is associated with the pulleys 30*a*, 30*b* by attachments 33*a*, 33*b*. From the attachment with each pulley, the bowstring 32 extends in a groove along a linear section of the outer cam, around the outer cam and then off of the outer cam to the nock 36 and opposite pulley. Power cables 34*a*, 34*b* are associated with the inner cam of each pulley 30*a*, 30*b*. The power cable 34*a* is attached to an inner portion of pulley 30*a*, extends partially around the inner cam, off of the inner cam to near the opposite pulley 30*b* where it is attached to the limb 28*b*. The power cable 34*b* is oppositely arranged.

Each power cable 34 can be split prior to attaching to its respective limb, the two split cables of each power cable 34 then attach to an opposite side of each limb. Such a configuration calls for a cable guard near the nock to prevent the power cable from interfering with the arrow during draw and upon release. Alternatively, each of the power cables 34 can be split at a point between its attachment to the pulley 30*a* or 30*b* and the mid-point of the bow, i.e., prior to passing by the nock 36. The alternative configuration requires a cable separator and is described in more detail below in connection with FIGS. 3, 4 and 5.

The brace height of the bow 10, which is measured from the belly of the grip at its deepest point to the bowstring when at rest (not drawn), is about 10½ inches. In an embodiment of the bow in which a centrally rotating wheel is used in place of a cam type pulley, the brace height is preferably about 11½ inches. The 10½ inch brace height of the bow 10 provides a short power stroke of about 17 to 18 inches with a draw length of about 30 inches. (The draw length is not exactly the sum of the brace height and power stroke because draw length is measured from the grip to the nock when drawn, which is not precisely normal to the position of the bowstring when at rest. The brace height and distance of the power stroke, on the other hand, are normal to the position of the bowstring when at rest.) The ratio of the brace height to the distance between the axles is quite high, preferably greater than 3 to 7.

The combination of such a short power stroke and the very short distance between the axles would produce unpredictable accuracy in a conventional compound bow. However, it has been unexpectedly found that the bow 10, with its novel riser design, does not exhibit these problems.

Instead, an arrow released from the bow 10 is remarkably accurate. The improved performance of the bow 10 is believed to be attributable to the placement-of the majority of the bow's mass well rearward of the grip 18 in combination with the limb-engaging portions of the riser substantially in vertical alignment with the grip. The combination of features imparts excellent balance to the bow 10 when it is fully drawn. As noted above, the center of mass 22 is located above and rearward of the grip 18. The center of mass 22, provides the bow with the vertical axis of balance located about one quarter the brace height or more from the belly of the grip at its deepest point. Preferably, the vertical axis of balance is located rearward of the grip by no less than about 20% of the brace height in order to provide the bow 10 with excellent balance at full draw. The balance at full draw compensates for any adverse affect on accuracy that would be expected of a bow having such a short axle to axle bow length.

The entire riser 12 can be formed of unitary construction or, alternatively, provided with end portions 38, 40 that are adapted to slide forwardly and rearwardly with respect to the grip 18. In embodiments having slideable end portions, the riser is made of at least three distinct portions. A middle section, which includes the grip 18, has a top 42 and a bottom 44. The top end portion 38 is slideably engaged with the top 42 of the middle section, and the bottom end section 40 is slideably engaged with the bottom 44 of the middle section. Thus, the top and bottom end sections 38, 40 are rearwardly and forwardly adjustable in relation to the middle section.

Figure 2:
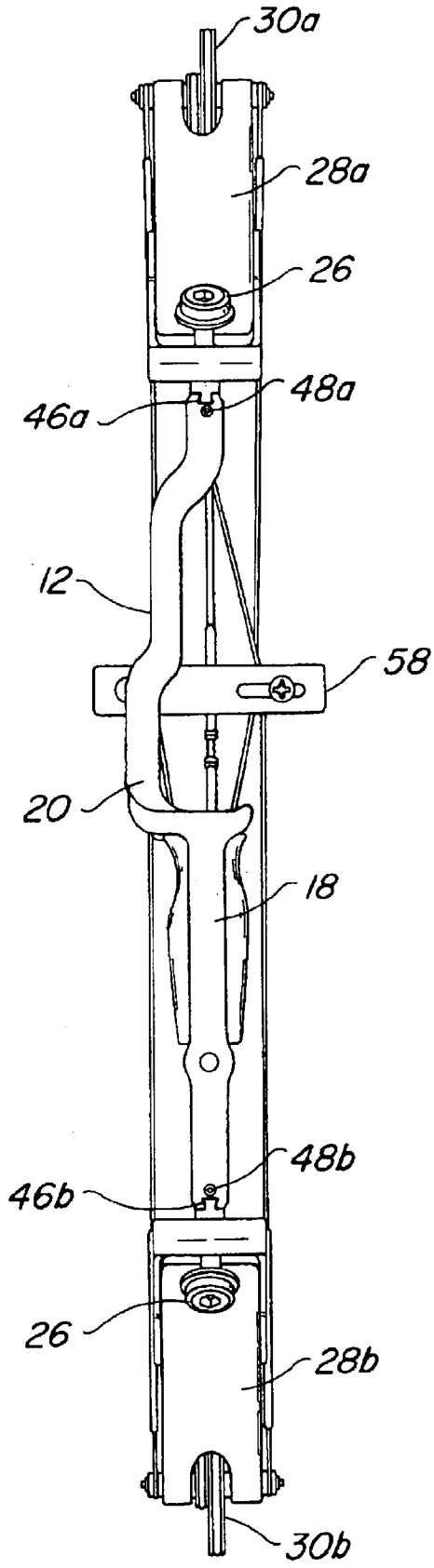
FIG. 2 is a view of the compound bow of FIG. 1 looking rearwardly at the back of the riser.

The top end portion 38 supports the limb 28*a* at the pre-selected angle LA via the limb pocket 24*a* in the manner previously described. Similarly, bottom end portion 40 supports the limb 28*b* at the pre-selected angle LB. The end portions 38, 40 can be slid along a dove tail groove 46*a*, 46*b*, shown in FIG. 2, in order to adjust the brace height according to an individual user's preference. An adjustment mechanism can be used to adjust the slidable end portions 38, 40. The adjustment mechanism can be a worm screw rack. The worm screw 48*a* can be rotatably anchored into the back (or belly) of the riser so that its helical threads extend slightly above the top 42 of the middle portion. The worm screw 48*a* can be driven by an allen wrench, or other well known screw head configurations, such as phillips, slotted or square, could be used. The central portion of the dove tail groove of the top end portion 38 can be provided with the rack to engage the threads of the worm screw 48*a*. Thus, a user can adjust the top end portion 38 forwardly and rearwardly relative to the middle portion (and grip 18) by turning the worm screw 48*a*. The bottom 44 of the middle section and the bottom end portion 40 can be similarly provided with a worm screw rack at the dove tail groove 46*b*, the worm screw being shown as element 48*b*. It is also contemplated that the worm screws can be provided in the end portions 38, 40, in which case the racks would be provided on the top 42 and bottom 44 of the middle section.

A rack and pinion system can be used as an alternative adjustment mechanism, in which case the pinion would be rotatably anchored in the side of the riser or top 42 and bottom 44 portions. Worm screw racks and rack and pinion systems are known in the mechanical arts and are described in *Practical Pictorial Guide to Mechanisms and Machines*, by Simon S. Palestrant, 1956, pages 116, 117, which is incorporated herein by reference.

The end portions 38, 40 can be removable from the middle section of the riser 12. In that case, different end portions, which support the limbs 28 at pre-selected angles different than angles LA and LB, can be slid onto the riser 12. It is contemplated that several interchangeable end portions can be provided and selected according to the user's preference.

Figure 3:
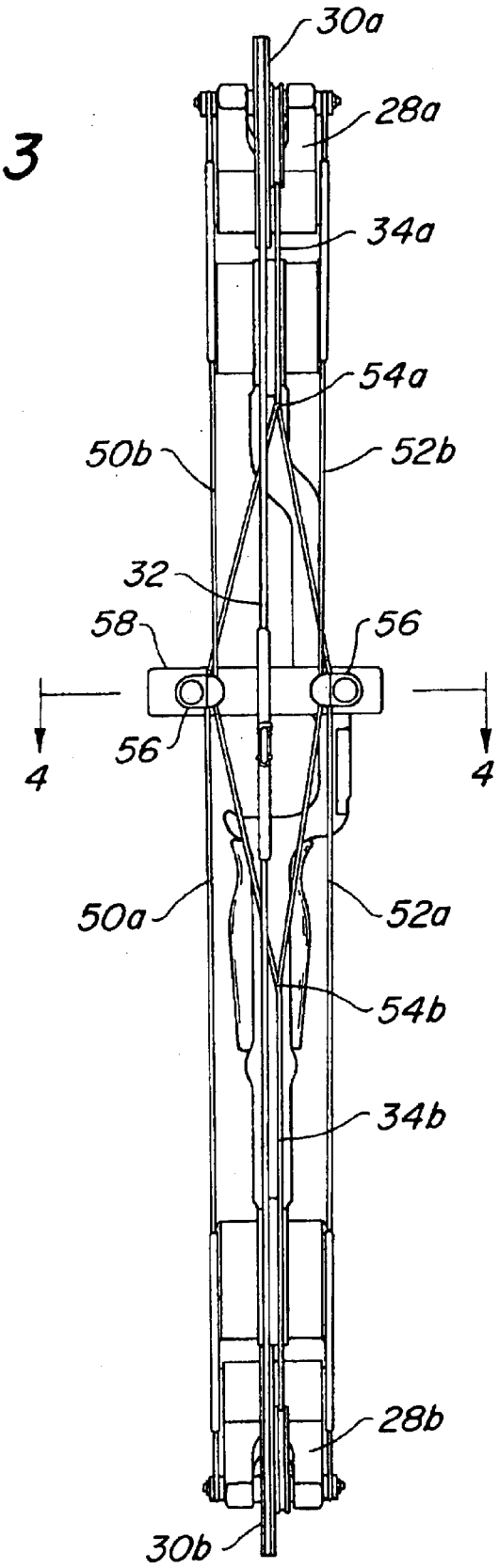
FIG. 3 is a view of the compound bow of FIG. 1 looking forwardly at the bowstring and belly of the riser.
Figure 4:
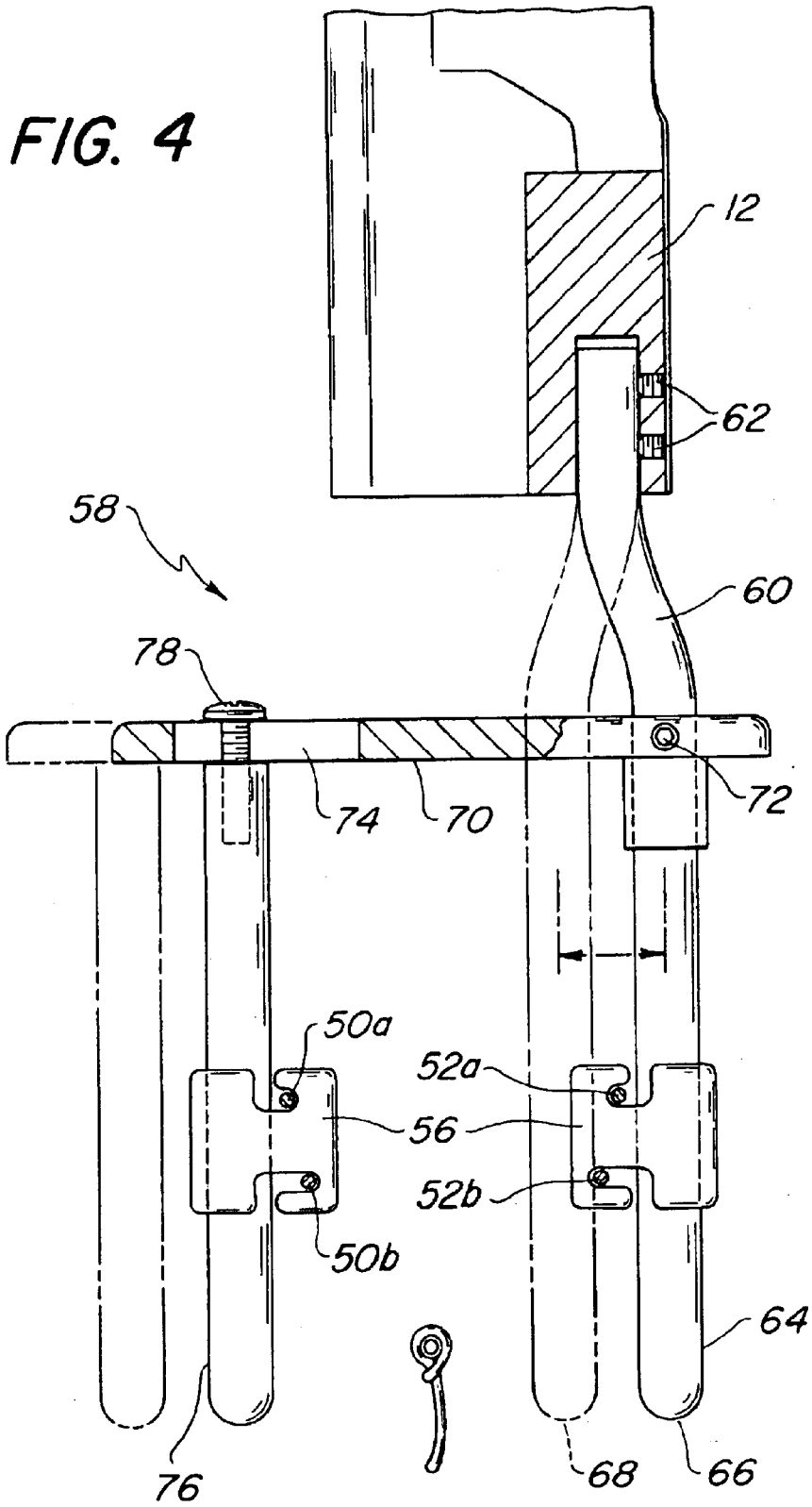
FIG. 4 is a cross-sectional view of a power cable separator as seen through line 4—4 in FIG. 3.
Figure 5:
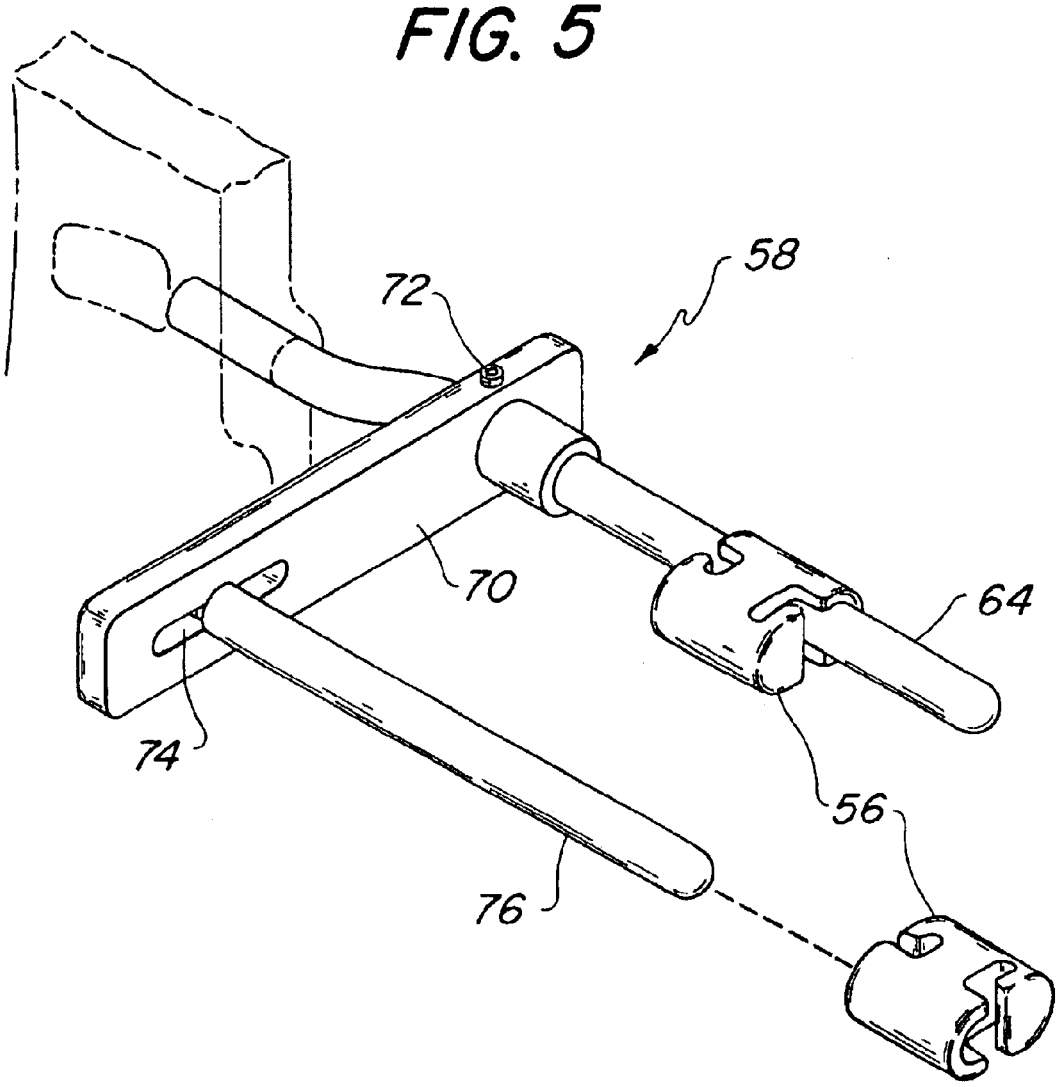
FIG. 5 is a perspective view of the power cable separator

The above mentioned alternative power cable configuration is described with reference to FIGS. 3–5. The bowstring 32 communicates with power cable 34*a* at pulley 30*a* and with power cable 34*b* at pulley 30*b*. Power cord 34*a* extends downwardly from pulley 30*a* and is split into two cable segments 50*a* and 52*a* at a splice 54*a*. The cable segments 50*a*, 52*a* pass through cable guards 56 on opposite sides of the plane of the bowstring 32. The cable segments 50*a*, 52*a* run in a substantially parallel fashion from the cable guards 56 to the limb 28*b*, where they attach to the limb 28*b* on opposite sides of the pulley 30*b*. Power cable 34*b* is arranged between pulley 30*b* and limb 28*a* in a similar way, splitting into cable portions 50*b*, 52*b* at splice 54*b*, passing through the cable guards 56 and attaching to limb 28*a* on opposite sides of pulley 30*a*.

Cable guards 56 prevent the cable segments 50*a*, 50*b*, 52*a* and 52*b* from interfering with the movement of the bowstring 32 and an arrow being released. The cable guards 56 are adjustably supported by a power cable separator 58. The power cable separator 58 can be adjusted according to user preference to achieve a wide range of possible cable guard positions. In addition, interior cable guards 56, as shown in the drawings, or exterior cable guards can be used. The power cable separator 58 includes a curved mounting rod 60 that engages a mounting orifice in the belly of the riser 12. Threaded orifices 62, which are adapted to receive set screws, are provided in the riser adjacent the mounting orifice. The mounting rod 60 extends into a first mounting finger 64 of the proper diameter to receive cable guard 56. Rotation of the mounting rod 60 within the mounting orifice achieves movement of the mounting finger 64 from the position identified by reference numeral 66 to the alternative position identified by reference numeral 68. Depending on the user's preference, the mounting finger 64 can also be set in any position in between.

A connecting plate 70 extends transversely from mounting finger 64. Once the mounting finger 64 is set in the desired position, the connecting plate 70 can be rotated about mounting finger 64 to project through the plane of the bowstring. When appropriately positioned, the connecting plate 70 is set relative to the finger 64 by a set screw 72. The connecting plate 70 includes a slot 74 remote from the set screw 72. A second mounting finger 76 engages the connecting plate 70 and is held in place by a screw 78 projecting through the slot 74. When the screw 78 is loosened, the second mounting finger 76 and screw 78 are free to slide along the slot 74 toward or away from the first mounting finger 64. When in the desired position, the screw 78 is tightened to fix the second mounting finger 76 in place.

In use, the first mounting finger 64 is initially adjusted, by rotating the curved mounting bar 60, to a position at a desired distance from the plane of the bowstring. Once properly positioned, the first mounting finger 64 is fixed by tightening one or more set screws inserted in the orifices 62. The connecting plate 70 is then rotated about the first mounting finger 64 so that it extends through the plane of the bowstring and set. The second mounting finger 76 is then positioned at the desired distance from the plane of the bowstring by sliding of screw 78 through the slot 74. When so positioned, the screw 78 is tightened to fix the second mounting finger 76 in place. Cable guards 56 can be slid onto the mounting fingers at any time. Once both mounting fingers are fixed in place, the cable segments 50*a* and 50*b* are inserted into recesses in the cable guard 56 mounted on the second mounting finger 76. The cable segments 52*a* and 52*b* are similarly inserted into recesses in the cable guard 56 mounted on the first mounting finger 64. The cable segments 50*a*, 50*b*, 52*a* and 52*b* slide freely through the cable guards 56 when the bow is drawn and released. However, the cable segments are kept safely away from the plane of the bowstring.

A variety of modifications to the embodiments described will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A compound bow comprising:

a riser having a vertical length, the riser comprising a forward grip, a vertically extending portion comprising the majority of the length of the riser, the vertically extending portion being attached rearward of the grip, and a limb-engaging portion at each end of the vertically extending portion, the limb-engaging portions extending forwardly from the vertically extending portion so that the limb-engaging portions are substantially in vertical alignment with the grip;

a resiliently flexible limb supported at each limb-engaging portion and extending at a rearward angle therefrom;

a pulley mounted on an axle at the end of each limb rearwardly of the riser, the distance between the axles being less than 28 inches; and a bowstring associated with the pulleys.

2. The compound bow of claim 1 further comprising a brace height, wherein the ratio of the brace height to the distance between the axles is greater than 3 to 7.

3. The compound bow of claim 1 further comprising a brace height and a vertical axis of balance, wherein the distance from the belly of the grip at its deepest point to the vertical axis of balance is greater than 20% of the brace height.

4. The compound bow of claim 3 wherein the distance from the belly of the grip at its deepest point to the vertical axis of balance is about a quarter of the brace height or more.

5. The compound bow of claim 1 wherein the grip and limb-engaging portions are disposed forward of a vertical axis of balance and the vertically extending portion is disposed rearward of the vertical axis of balance.

6. The compound bow of claim 1 wherein the distance between the axles is about 23 inches to about 25 inches.

7. The compound bow of claim 1 wherein the riser further comprises end portions adapted to slide forwardly and rearwardly with respect to the grip.

8. The compound bow of claim 7 wherein the end portions each support a limb at a pre-selected angle, and the end portions are removable and interchangeable with different end portions that each support a limb at a different pre-selected angle.

9. The compound bow of claim 1 further comprising a power cable separator proximate to a path of arrow movement.

10. A compound bow comprising:

a riser having a vertical length, the riser comprising a forward grip, a vertically extending portion comprising the majority of the length of the riser, the vertically extending portion being are formed of unitary construction with the grip and attached rearward of the grip, and a limb-engaging, portion at each end of the vertically extending portion, the limb-engaging portions extending forwardly from the vertically extending portion so that the limb-engaging portions are substantially in vertical alignment with the grip;

a resiliently flexible limb supported at each limb-engaging portion and extending at a rearward angle therefrom;

a pulley mounted on an axle at the end of each limb rearwardly of the riser; and a bowstring associated with the pulleys.

11. The compound bow of claim 10 further comprising a brace height, wherein the ratio of the brace height to the distance between the axles is greater than 3 to 7.

12. The compound bow of claim 10 further comprising a brace height and a vertical axis of balance, wherein the distance from the belly of the grip at its deepest point to the vertical axis of balance is greater than 20% of the brace height.

13. The compound bow of claim 12 wherein the distance from the belly of the grip at its deepest point to the vertical axis of balance is about a quarter of the brace height or more.

14. The compound bow of claim 10 wherein the grip and limb-engaging portions are disposed forward of a vertical axis of balance and the vertically extending portion is disposed rearward of the vertical axis of balance.

15. The compound bow of claim 10 wherein the distance between the axles is about 23 inches to about 25 inches.

16. The compound bow of claim 10 wherein the riser further comprises end portions adapted to slide forwardly and rearwardly with respect to the grip.

17. The compound bow of claim 16 wherein the end portions each support a limb at a pre-selected angle, and the end portions are removable and interchangeable with different end portions that each support a limb at a different pre-selected angle.

18. The compound bow of claim 10 further comprising a power cable separator proximate to a path of arrow movement.

19. A compound bow comprising:

a riser comprising a grip having a belly forward of and connected to a vertically extending portion;

a resiliently flexible limb extending at a rearward angle from each end of the riser;

a pulley mounted on an axle at the end of each limb rearwardly of the riser; and a bowstring associated with the pulleys and, in combination with the grip, defining a brace height;

a vertical axis of balance located rearwardly of the deepest point of the belly of the grip by a distance of at least 20% of the brace height.

20. The compound bow of claim 19 wherein the riser has a vertical length and the vertically extending portion comprises most of the length of the riser.

21. The compound bow of claim 19 wherein the distance from the belly of the grip at its deepest point to the vertical axis of balance is about a quarter of the brace height or more.

22. The compound bow of claim 19 wherein the distance between the axles is about 23 inches to about 25 inches.

23. The compound bow of claim 19 wherein the ratio of the brace height to the distance between the axles is greater than 3 to 7.

24. The compound bow of claim 19 wherein the riser further comprises end portions adapted to slide forwardly and rearwardly with respect to the grip.

25. The compound bow of claim 19 further comprising a power cable separator proximate to a path of arrow movement.

26. A compound bow having a vertical axis of balance, the bow comprising:

a riser having a vertical length, the riser comprising a grip disposed forward of a vertical axis of balance;

a vertically extending portion disposed rearward of the vertical axis of balance and comprising substantially all of the vertical length, and a limb-engaging portion at each end of the vertically extending portion, the limb-engaging portions being disposed forward of the vertical axis of balance;

a resiliently flexible limb extending at a rearward angle from each limb-engaging portion;

a pulley mounted on an axle at the end of each limb rearwardly of the riser; and a bowstring associated with the pulleys;

the bow having a brace height, the ratio of the brace height to the distance between the axles being greater than 3 to 7.

27. The compound bow of claim 26 wherein the distance from the belly of the grip at its deepest point to the vertical axis of balance is greater than about 20% of the brace height.

28. The compound bow of claim 26 wherein the distance between the axles is less than 28 inches.

29. The compound bow of claim 26 wherein the limb-engaging portions are adapted to slide forwardly and rearwardly with respect to the grip.

30. A compound bow comprising:

a riser comprising a middle section having a top and bottom, a top end section slideably engaged with the top of the middle section, and a bottom end section slideably engaged with the bottom of the middle section, the top and bottom end sections being rearwardly and forwardly adjustable in relation to the middle section;

a limb rearwardly extending from each of the top and bottom end sections; and a bowstring extending between the free ends of the limbs.

31. The compound bow of claim 30 wherein the top and bottom sections are adjustable in relation to the middle section via a worm screw.

32. The compound bow of claim 30 wherein the top and bottom sections are slideably engaged with the middle section via a dove tail groove.

33. The compound bow of claim 30 wherein the bowstring is associated with pulleys mounted on an axle at the free end of each limb, the middle section of the riser comprises a grip mounted forwardly of the majority of the mass of the riser, the positions of the bowstring and grip defining a brace height, and the ratio of the brace height to the distance between the axles is greater than 3 to 7.

34. The compound bow of claim 33 wherein the top and bottom sections can be adjusted rearwardly and forwardly to change the ratio of the brace height to the distance between the axles from greater than 3 to 7 to less than 3 to 7.

35. The compound bow of claim 30 wherein the riser further comprises a grip disposed forwardly of a vertical axis of balance and a vertically extending portion disposed rearwardly of the vertical axis of balance.

36. The compound bow of claim 35 wherein the bow has a brace height and a grip and wherein the vertical axis of balance is a distance greater than 20% of the brace height from the grip at its deepest point.

37. The compound bow of claim 30 wherein the middle section further comprises a forward grip and a vertically extending portion rearward of the grip and wherein the top and bottom end sections each comprise a limb engaging portion substantially in vertical alignment with the grip.

* * * * *